US008403647B2

(12) United States Patent
Stimpson et al.

(10) Patent No.: US 8,403,647 B2
(45) Date of Patent: Mar. 26, 2013

(54) SHOWER WASTE PUMP CONTROL DEVICE

(75) Inventors: Robert William Stimpson, Douglas (IM); Yanchun Wang, Ballasalla (IM); Graham Robin Lock, Glen Vine (IM); James Edward Self, Colby (IM); Nicholas Parsons, Onchan (IM)

(73) Assignee: DLP Limited, Isle of Man (GB)

( * ) Notice: Subject to any disclaimer, the term of this patent is extended or adjusted under 35 U.S.C. 154(b) by 1033 days.

(21) Appl. No.: 11/911,018

(22) PCT Filed: Feb. 20, 2006

(86) PCT No.: PCT/GB2006/000579

§ 371 (c)(1),
(2), (4) Date: Oct. 9, 2007

(87) PCT Pub. No.: WO2006/120369

PCT Pub. Date: Nov. 16, 2006

(65) Prior Publication Data

US 2008/0213101 A1 Sep. 4, 2008

(30) Foreign Application Priority Data

May 10, 2005 (GB) ..... 0509461.0

(51) Int. Cl.
*F04B 49/00* (2006.01)

(52) U.S. Cl. ..... 417/12

(58) Field of Classification Search ..... 417/12, 417/36, 43, 43.3, 234, 423.15; 4/603
See application file for complete search history.

(56) References Cited

U.S. PATENT DOCUMENTS 4,222,711 A 9/1980 Mayer et al.
4,881,873 A 11/1989 Smith
5,152,670 A 10/1992 Waldecker et al.
(Continued)

FOREIGN PATENT DOCUMENTS

EP 0 373 809 A 6/1990
GB 2276541 A 10/1994
(Continued)

OTHER PUBLICATIONS

Contour Showers—News—www.contour-showers.co.uk/news, May 2004, pp. 1-2, Contour's Smart Digital Pump.

(Continued)

*Primary Examiner* — Devon Kramer
*Assistant Examiner* — Amene Bayou
(74) *Attorney, Agent, or Firm* — Fleit Gibbons Gutman Bongini & Bianco, PL; Paul D. Bianco; Martin Fleit

(57) ABSTRACT

A control device for controlling a shower waste pump, includes a housing, a pump setting, and an over-run setting. The pump setting, by way of a control element, preferably a manually adjustable potentiometer, allows selective setting of a maximum pumping capacity of the waste pump. The over-run setting, also by way of a control element, allows selective setting of an over-run period from a predetermined range during which the waste pump continues to operate after fluid flow through the waste pump has ceased or substantially ceased. The over-run setting and the pump setting together optimize operation of the waste pump, so that the over-run period of the waste pump can be set based on the selected maximum pumping capacity.

8 Claims, 5 Drawing Sheets

U.S. PATENT DOCUMENTS

| | | | | |
|---|---|---|---|---|
| 5,466,995 | A * | 11/1995 | Genga | 318/3 |
| 2002/0190687 | A1 | 12/2002 | Bell et al. | |
| 2003/0196942 | A1 * | 10/2003 | Jones | 210/169 |
| 2004/0013531 | A1 * | 1/2004 | Curry et al. | 417/42 |
| 2004/0055363 | A1 * | 3/2004 | Bristol | 73/31.03 |
| 2006/0045750 | A1 * | 3/2006 | Stiles | 417/42 |

FOREIGN PATENT DOCUMENTS

| | | | |
|---|---|---|---|
| GB | 2294636 | A | 5/1996 |
| GB | 2310374 | A | 8/1997 |
| GB | 2355653 | A | 5/2001 |

OTHER PUBLICATIONS

International Preliminary Report on Patentability for PCT/GB2006/000579, Nov. 13, 2007.

Written Opinion of the International Search Authority for PCT/GB2006/000579, Nov. 13, 2007.

International Search Report for PCT/GB2006/000579, Nov. 13, 2007.

British Search Report for GB0509461.0 (priority document), Jul. 28, 2005.

* cited by examiner

SHOWER WASTE PUMP CONTROL DEVICE

FIELD OF THE INVENTION

The present invention relates to a control device for controlling a shower waste pump.

BACKGROUND OF THE INVENTION

The prior art is demonstrated by Whale Water Systems, of Old Belfast Road, Bangor, Co. Down, Northern Ireland, who provide a control device for a shower waste pump which is sited between a transformer of the waste pump and the pump itself. The control device includes a flow sensor locatable in the water supply to the shower control for monitoring the presence and/or flow rate of shower water. The control device provides a fixed start up delay, variable pumping rate based on an assumed maximum pumping capacity, and a selectable over-run period of the pump. The intention is to match pump operation to shower operation to effectively drain a shower tray.

However, following installation, the over-run period is the only settable parameter that can be manually altered. The pump start up delay cannot be adjusted, and the pumping rate is controlled by circuitry with regard to inputs received from the flow sensor.

To adjust the over-run period, a housing of the control device must first be removed from a supporting surface, since access is only via the back surface. The over-run period can then be manually adjusted to one of three over-run periods, typically being 30 seconds, 120 seconds and 240 seconds.

This control device thus has limited functionality, resulting in less than optimal noise reduction and efficiency of operation. Access to the single user adjustable setting is also particularly difficult.

The present invention seeks to provide a solution to these problems.

SUMMARY OF THE INVENTION

According to the present invention, there is provided a control device for controlling a shower waste pump, the device comprising a housing which is mountable to a supporting surface, pump setting means located in and/or on the housing for selectively setting a maximum pumping capacity of the waste pump, and over-run setting means located in and/or on the housing for selectively setting an over-run period from a predetermined range during which the waste pump continues to operate after fluid flow through the waste pump has ceased or substantially ceased, in use the over-run period set by the over-run setting means being, at least in part, determinable by the maximum pumping capacity of the waste pump set by the pump setting means so as to optimise operation of the waste pump.

BRIEF DESCRIPTION OF THE DRAWINGS

Preferable and/or optional features of the first aspect of the invention are set forth below.

The invention will now be more particularly described, by way of example only, with reference to the accompanying drawings, in which.

DETAILED DESCRIPTIN OF THE INVENTION

Figure 1:
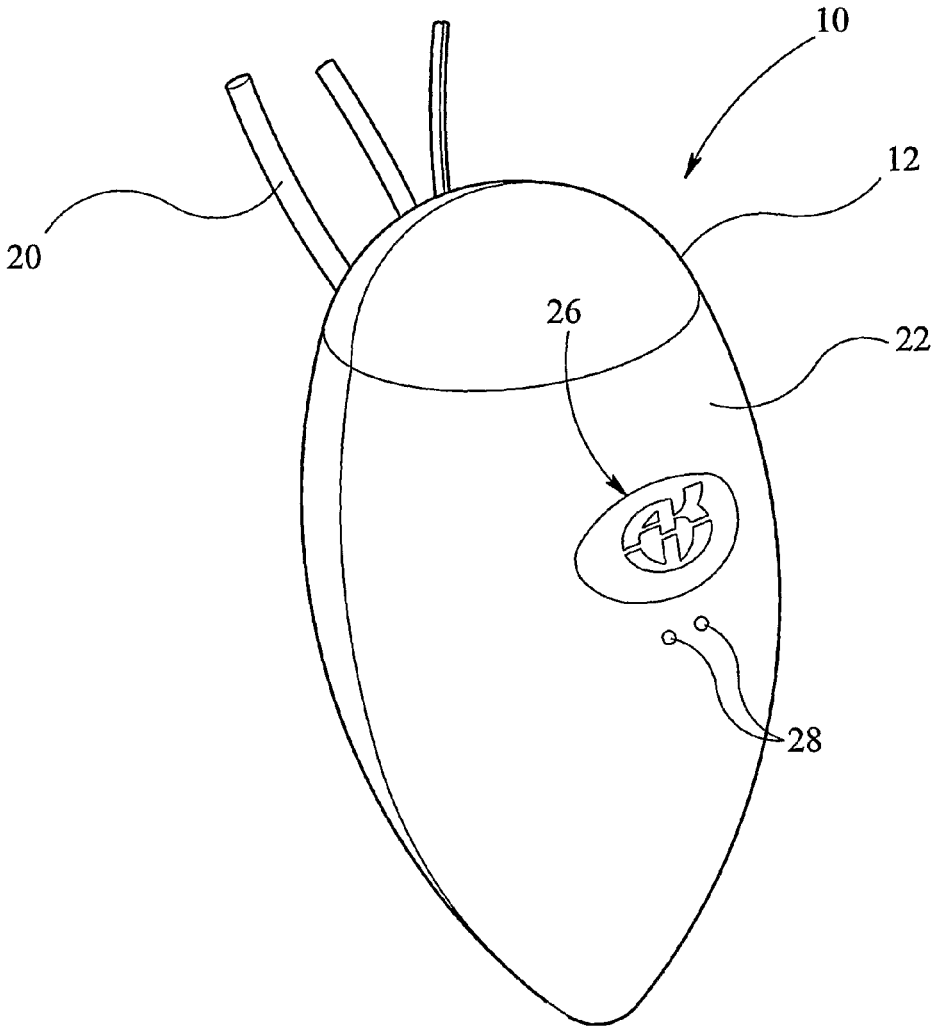
FIG. 1 is a perspective view of a housing of a control device for controlling a shower waste pump, in accordance with the invention.
Figure 2:
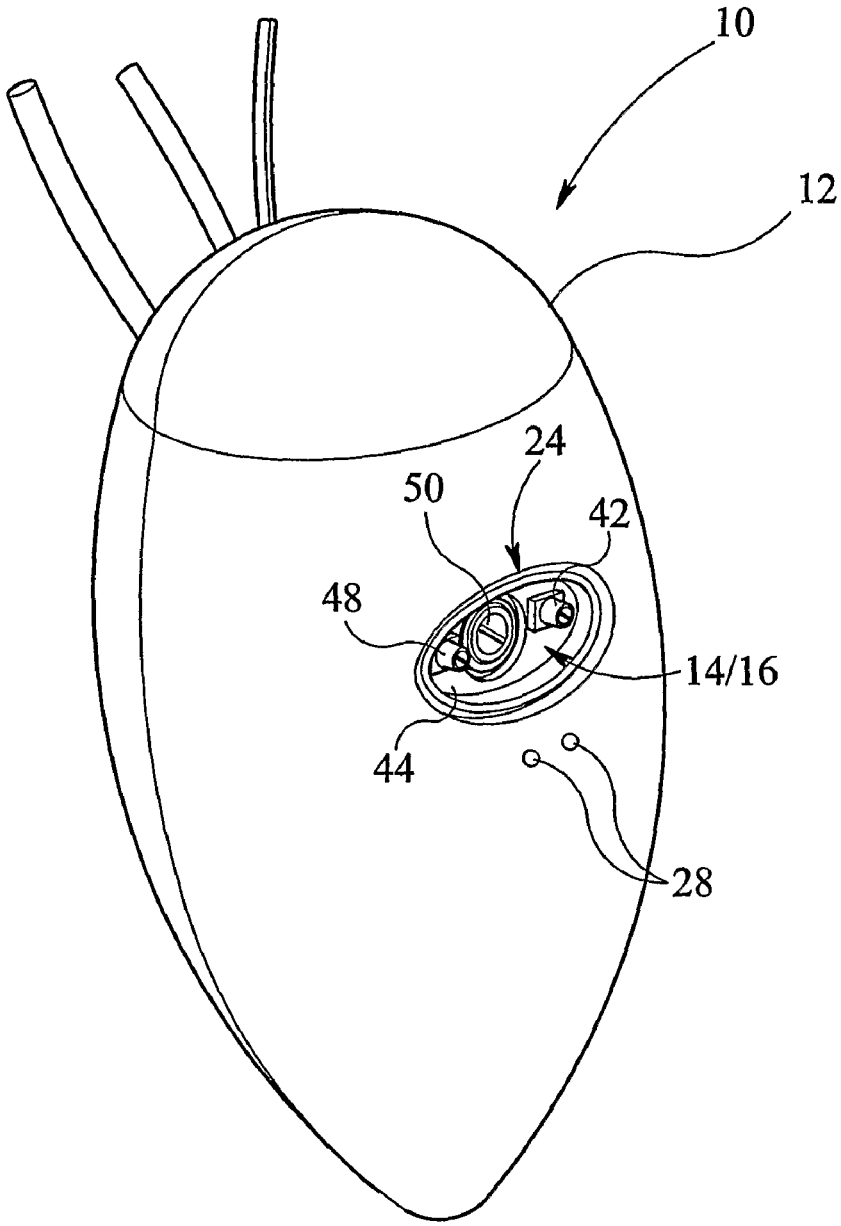
FIG. 2 is a view similar to that of FIG. 1, with a front access cover removed.
Figure 3:
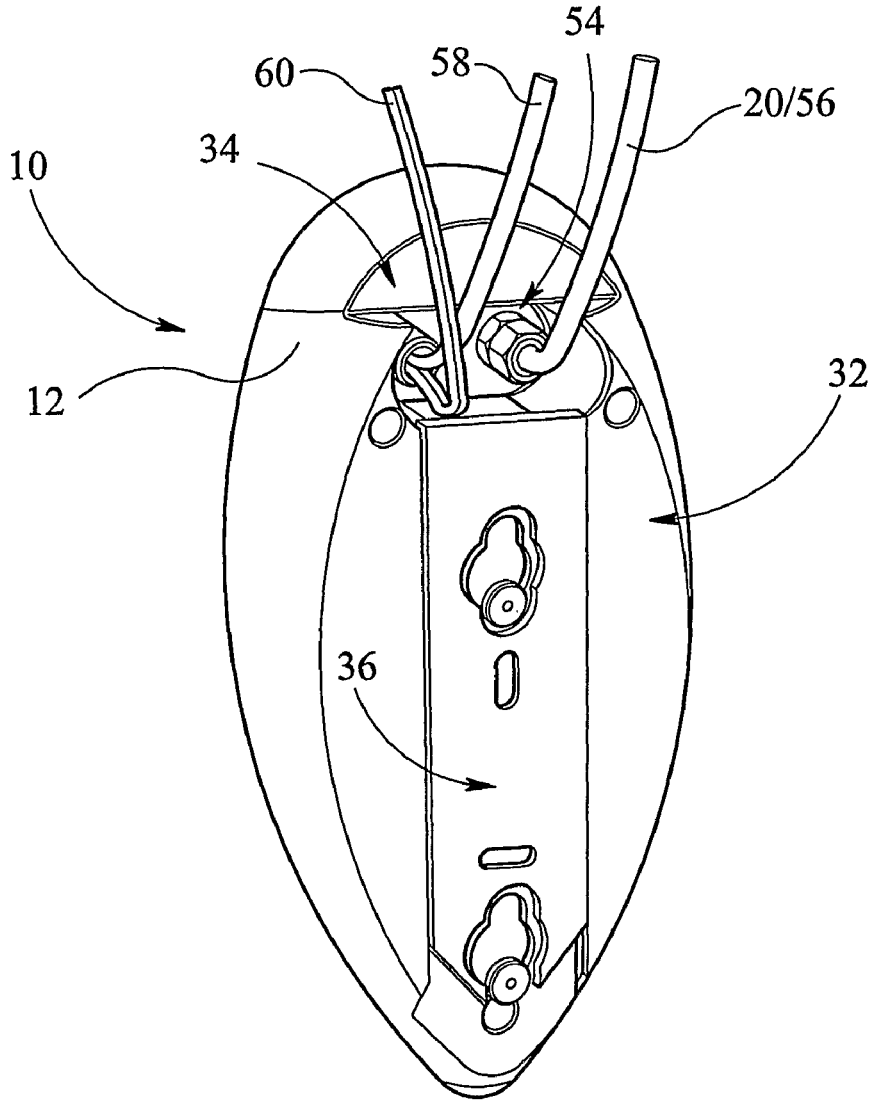
FIG. 3 is a rear view of the control device.

Referring to the drawings, there is shown a control device 10 for controlling a shower waste pump (not shown), which comprises a, typically moulded plastics, housing 12, pump setting means 14 and over-run setting means 16 both provided in the housing 12, a pump start-up circuit 18 also located in the housing 12, and waste water sensing means (not shown) providing feedback to the pump setting means 14, over-run setting means 16 and pump start-up circuit 18.

The housing 12 is generally elliptical or egg-shaped, which enables positioning in at least two different orientations dependent on access to a mains power supply 20. The housing 12 includes a removable and liquid-tightly sealable front cover 22 in which is formed an access opening 24 providing user access to the pump setting means 14 and the over-run setting means 16.

The housing 12 also includes a removable elastomeric cap 26 which, when located on the front cover 22 of the housing 12, liquid-tightly seals the access opening 24; and two transparent or translucent light covers 28 for protecting internally disposed indicator lights 30. The cap 26 is solely press-fit, without the need for any separate fastening device, such as a screw, and can thus be removed from the housing 12 without the use of a tool.

The elastomeric cap 26 includes a brand name, and/or other information, and can be located in at least two different orientations. This permits flexibility in the positioning of the housing 12, while allowing the displayed brand name/information to be displayed in a normal, easy to read manner.

The rear 32 of the housing 12 (see FIG. 4) includes a recess 34 for accepting cabling entering and exiting the control device 10; and a mounting bracket 36 for removably mounting the control device 10 to a supporting surface, typically being a wall.

Figure 4:
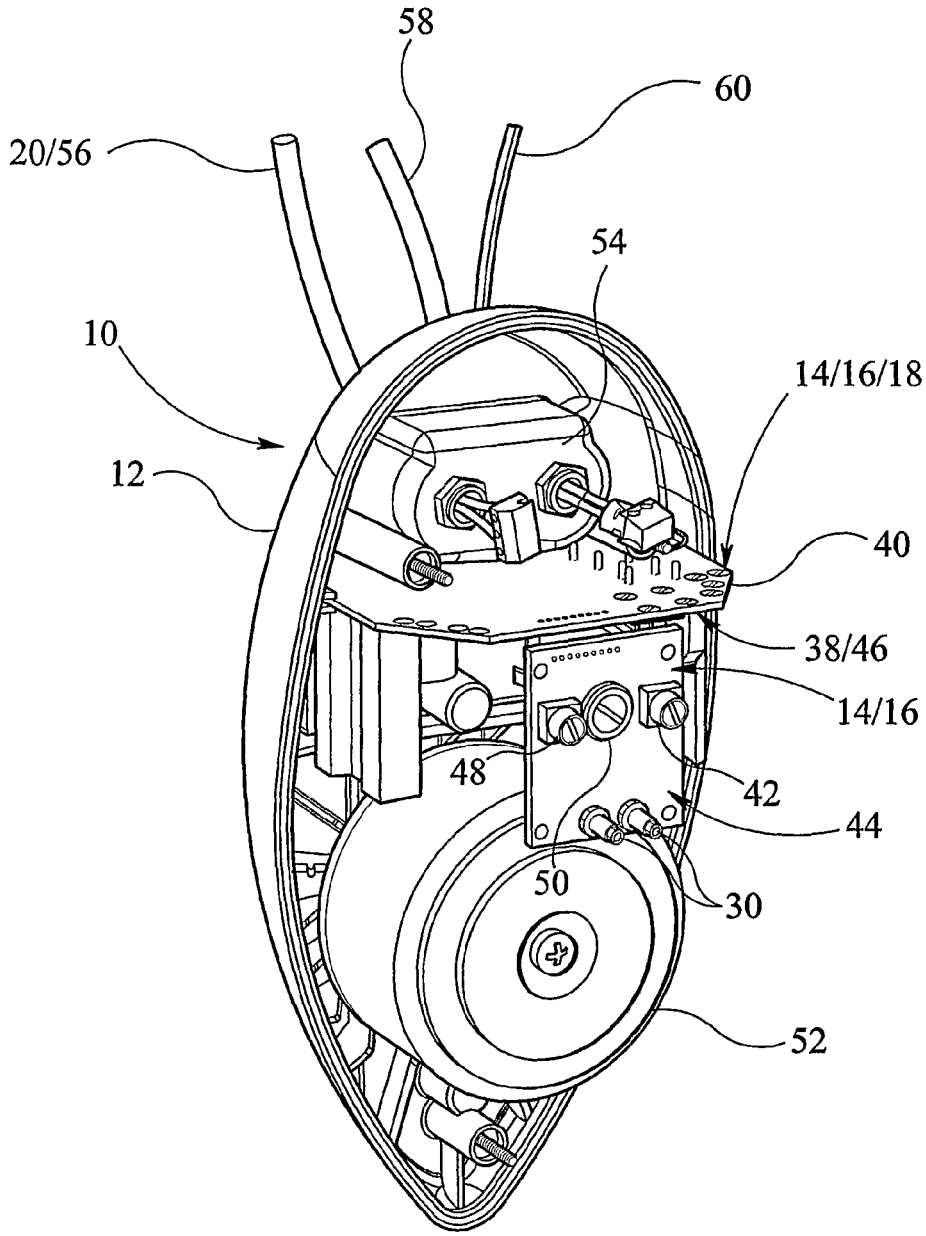
FIG. 4 shows the control device with a front housing cover removed.
Figure 5:
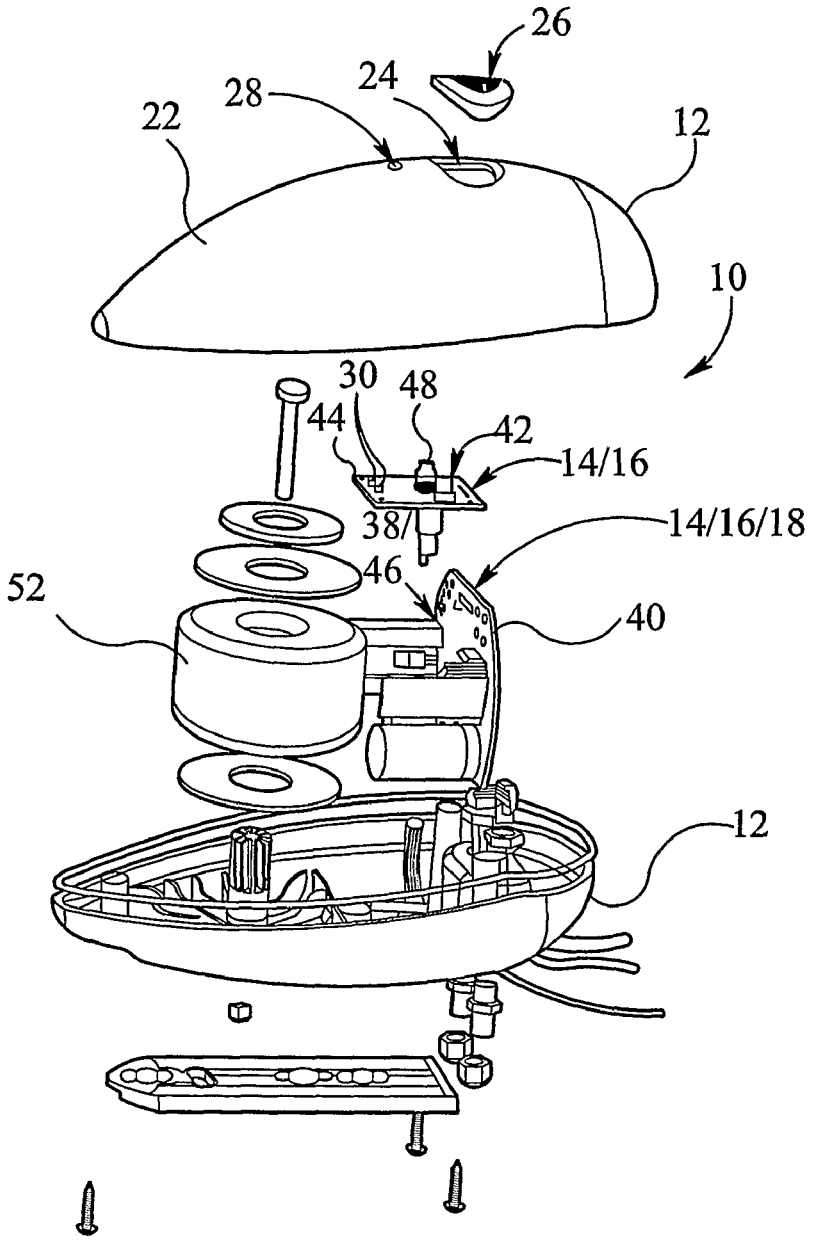
FIG. 5 is an exploded view of the control device.

As can be seen in FIGS. 4 and 5, the pump setting means 14 includes a control circuit 38 mounted on a main PCB 40 for controlling a voltage of the waste pump, and a first manually adjustable potentiometer 42 mounted on a secondary PCB 44 which is positioned adjacent to the access opening 24 of the housing 12. The voltage with which the waste pump is operated is continuously modulated based on signals received from the waste water sensing means, which may be any suitable variable flow detection or monitoring device.

The first potentiometer 42 enables manual setting of a maximum voltage with which the waste pump can be operated, up to and including a manufacturers recommended maximum operational voltage. This maximum voltage is determined based on the required pumping capacity of the waste pump, which in turn is dependent on the typical maximum flow rate of water outputable by an associated shower head.

The over-run setting means 16 includes a timing circuit 46 also provided on the main PCB 40 for operating the waste pump for a period after a signal from the waste water sensing means indicates that waste water has ceased or substantially ceased flowing, and a second manually adjustable potentiometer 48 mounted on the secondary PCB 44. The second potentiometer 48 enables manual setting of an over-run period from a predetermined range. The predetermined range is typically 0 seconds to 240 seconds, but may be any suitable range.

The use of potentiometers 42 and 48 is particularly advantageous, since it allows infinite adjustment across the permitted ranges.

However, other types of control elements could be utilised instead of potentiometers, such as a digital control interface.

The pump start-up circuit 18 is known from the prior art. In this case, it is also included on the main PCB 40. It is set to provide a predetermined fixed period of delay from the start of water flow, when indicated by the waste water sensing means. Typically, the delay is 5 seconds, but may be any suitable period. In the present case, this delay is not user adjustable. However, it could be manually adjustable using a potentiometer or other control element as described above.

The secondary PCB 44 is located so that a user can access the control elements through the access opening 24 of the housing 12, once the elastomeric cap 26 has been removed.

Conveniently, a safety fuse 50 is mounted on the secondary PCB 44, enabling quick access via the access opening 24 of the housing 12.

The two operating indicator lights 30 are also mounted on the secondary PCB 44, and are positioned adjacent the light covers 28 when the front cover 22 of the housing 12 is in place.

A toroidal DC step-down transformer 52 is also housed in the housing 12.

A liquid-tight cable gland 54 allows cabling to enter the housing 12 at the recess 34 in the rear 32 of the housing 12. For example, a cable 56 of the mains power supply 20, a power supply cable 58 to the waste pump, and a cable 60 from the waste water sensing means all enter and exit the housing 12 via the rear recess 34 and the gland 54.

The housing can, obviously, be any suitable shape. As such, the access opening of the housing can be provided in the front or side surface of the housing.

The user control elements, in this case being the potentiometers, could be mounted directly on the exterior surface of the housing, rather than within an access opening. In this case, the control elements would have to be water- and tamper-proof.

The waste water sensing means may not necessarily require a variable flow detection device. In an alternative arrangement, the waste water sensing means can be provided with a simple float switch in the trap, indicating the presence of waste water.

A further option requires the shower controls to be electrically connected to the control device, thereby enabling the waste water sensing means to provide an indication as to when the shower is operating.

The waste water sensing means may be dispensed with altogether. For example, in the case of a manually energisable shower unit, the pump may be activated by the control device once the shower unit is energised, independently of water flow from the shower head.

In the above modifications, however, the waste water sensing means does not provide an indication of variable flow rate. In this case, the first potentiometer of the pump setting means is used to set the maximum pumping capacity of the waste pump, and the waste pump is thus operated solely at this capacity, regardless of the actual volume of waste water.

It is thus possible to provide a control device for controlling a shower waste pump which permits infinite manual setting and adjustment of a maximum pumping capacity, and, preferably, continuous variation of the pumping capacity dependent on volume of waste water. It is also possible to manually set and infinitely adjust over a given range the over-run period, again allowing optimal operation of the pump. The combination of the settable maximum pumping capacity and the settable over-run period, all within a convenient single housing and accessible via a convenient single opening, enables the over-run setting period to be, at least in part, determined by the maximum pumping capacity of the waste pump so as to further optimise operation of the waste pump, and consequently improve energy efficiency and operational longevity. It is thus possible to optimally control the pump and thus to reduce noise and increase efficiency. Access to, and control of, the control device is vastly improved over the known arrangement, allowing tool-less access via the press-fit cap and simplified adjustment and operation once installed.

The embodiments described above are given by way of examples only, and further modifications will be apparent to persons skilled in the art without departing from the scope of the invention as defined by the appended claims.

The invention claimed is:

1. A control device for controlling a shower waste pump, the device positioned at a distance from the pump which it is to control and comprising:

a housing which is mountable to a supporting surface;

an access opening within the housing covered by a press-fit removable cap;

a first printed circuit board (PCB) located within the housing;

a second PCB adjacent to the access opening;

pump-setting means for manually adjusting and selectively setting maximum pumping capacity of the waste pump, the pump-setting means including a control circuit mounted on the first PCB for controlling voltage to the waste pump and a manually-operable voltage control element mounted on the second PCB for manually setting a maximum voltage at which the waste pump can be operated;

over-run setting means for selectively setting an over-run period from a pre-determined range during which the waste pump continues to operate after fluid flow through the waste pump has ceased or substantially ceased, the over-run setting means including a timing circuit mounted on the first PCB for continuing operation of the waste pump during the over-run period and a manually-operable over-run setting control element mounted on the second PCB for manually setting the over-run period; the press-fit removable cap provides toolless access to the pump-setting means and the over-run setting control element, wherein the over-run setting means allows the over-run period to be manually set and infinitely adjusted over a given range and the over-run period set by the over-run setting means is, at least in part, determinable by the maximum pumping capacity of the waste pump set by the pump-setting means so as to optimize operation of the waste pump.

2. The control device as claimed in claim 1, wherein the housing has an elliptical shape, the elliptical shape enabling mounting of the device to the supporting surface in at least two different orientations depending on access to an incoming mains power supply.

3. The control device as claimed in claim 1, wherein either one or both of the voltage control element and the over-run setting control element is a potentiometer.

4. The control device as claimed in claim 1, wherein the access opening is located in a front side or a side surface of the housing.

5. The control device as claimed in claim 1, wherein the press-fit removable cap is locatable on the housing in at least two different orientations.

6. The control device as claimed in claim 1, wherein the device further comprises waste fluid sensing means for indicating presence of waste fluid so that the device can activate the waste pump.

7. The control device as claimed in claim 6, wherein the fluid sensing means includes a variable flow detection device and the pump-setting means when adjusted manually continuously varies a capacity of the pump up to the selectively set maximum dependent on fluid flow detected by the variable flow detection device.

8. The control device as claimed in claim 6, wherein the fluid sensing means includes a flow detection device and the control device controls the waste pump to operate at only the selectively set maximum pumping capacity.

* * * * *